US005298358A

United States Patent [19]

Rubin et al.

[11] Patent Number: 5,298,358

[45] Date of Patent: Mar. 29, 1994

[54] METHOD AND APPARATUS FOR REPRODUCING IMAGE INFORMATION

[75] Inventors: Bruce J. Rubin; William Mey, both of Rochester; Dennis R. Kamp, Spencerport, all of N.Y.

[73] Assignee: Eastman Kodak Company, Rochester, N.Y.

[21] Appl. No.: 905,942

[22] Filed: Jun. 29, 1992

[51] Int. Cl.[5] ..... G03G 13/16

[52] U.S. Cl. ..... 430/126; 430/101

[58] Field of Search ..... 430/126, 120, 41, 175, 430/101

[56] References Cited

U.S. PATENT DOCUMENTS

| | | | |
|---|---|---|---|
| 3,410,203 | 11/1968 | Fischbeck | 101/1 |
| 3,574,657 | 4/1971 | Burnett | 117/8 |
| 3,601,484 | 8/1971 | Dybvig | 355/4 |
| 3,723,113 | 3/1973 | Goffe | 96/1.2 |
| 3,780,214 | 12/1973 | Bestenreiner et al. | 178/5.2 R |
| 3,798,030 | 3/1974 | Gundlach | 96/1 PS |
| 3,833,441 | 9/1974 | Heiart | 156/234 |
| 4,123,283 | 10/1978 | Goffe | 96/1 PS |
| 4,148,057 | 4/1979 | Jesse | 358/4 |
| 4,172,721 | 10/1979 | Byrne | 430/41 |
| 4,334,006 | 6/1982 | Kitajima et al. | 430/175 |
| 4,541,706 | 9/1985 | Kishi | 355/3 R |
| 4,772,922 | 9/1988 | Kawahara et al. | 355/32 |
| 4,942,419 | 7/1990 | Nakai et al. | 355/27 |

*Primary Examiner*—John Goodrow
*Attorney, Agent, or Firm*—Leonard W. Treash

[57] ABSTRACT

Method and apparatus for producing a hardcopy reproduction of image information. A uniform layer of toner particles is applied to a surface. A receiver sheet with a thermoplastic outer layer is placed over the layer of toner particles, the thermoplastic layer contacting the layer of toner particles. An electrostatic attraction is established between the layer of toner particles and the receiver sheet. The thermoplastic layer is imagewise exposed to heat to selectively soften the thermoplastic layer, allowing the toner particles opposite the softened thermoplastic to migrate into the layer. The receiver sheet is then removed from the surface, taking with it the migrated particles in an imagewise pattern.

18 Claims, 2 Drawing Sheets

METHOD AND APPARATUS FOR REPRODUCING IMAGE INFORMATION

CROSS-REFERENCE TO A RELATED APPLICATION

This application is related to commonly assigned U.S. patent application Ser. No. 07/621,691 filed Nov. 30, 1990 in the name of DeBoer et al.

BACKGROUND OF THE INVENTION

1. Field of the Invention

This invention relates generally to printing and reproduction apparatus, and specifically to image reproduction apparatus and methods for providing hardcopy reproduction of image information using marking particles.

2. Background Art

Laser-based printing systems are known in the art for producing hardcopy reproductions of image data. In particular, the above-referenced patent application discloses a laser-based printing apparatus in which a uniform layer of marking particles (toner) is deposited on and electrostatically attracted to a receiver sheet having a thermoplastic outer layer. A laser is then modulated in an imagewise fashion and scanned across the receiver sheet to selectively soften the thermoplastic layer. Toner particles adjacent the softened thermoplastic migrate into the thermoplastic layer under the influence of their electrostatic attraction to the receiver sheet. The toner particles which did not migrate into the thermoplastic layer are cleaned from the receiver sheet by a magnetic cleaning brush utilizing magnetic carrier particles. The image which remains on the receiver sheet is permanently fused to the receiver sheet.

A problem with this method of laser printing is that a large amount of toner particles must be removed from the receiver sheet in order to develop the image. The toner that is removed will have to be either discarded or recycled. Recycling of the toner within such a printer increases the complexity of such a printer.

SUMMARY OF THE INVENTION

In accordance with the invention, an improved laser printing method and apparatus are provided for producing a hardcopy reproduction of image information. According to the invention, a substantially uniform layer of toner particles is applied to the surface of an image-recording element. A receiver sheet having a thermoplastic outer layer is placed over the uniform layer of toner particles, the thermoplastic layer of the receiver sheet contacting the layer of toner particles. An electrostatic attraction is established between the layer of toner particles and the receiver sheet while the thermoplastic layer is imagewise exposed, preferably through the receiver sheet, to heat. Such exposure is effective to selectively soften the thermoplastic layer, allowing the toner particles opposite the softened thermoplastic to migrate into the layer. The receiver sheet is then removed from the surface, taking with it the migrated particles in an imagewise pattern.

In a refinement of the invention the receiver sheet is cleaned with a magnetic brush, utilizing hard magnetic carrier particles, to remove any background toner particles that remain on the receiver sheet. The image is permanently fixed to the receiver sheet by fusing it with heat and/or pressure. The surface of the recording element is retoned to obtain a uniform layer of toner particles for the next printing cycle.

The apparatus and method disclosed herein eliminates the necessity of having to remove a large amount of toner particles from the receiver sheet in order to create an image. A further advantage is that only a small amount of toner particles, those that have migrated into the thermoplastic layer of the receiver sheet, are removed from the surface. As a result, in order to prepare to make the next copy, only a small amount of toner particles need to be applied to the surface of the recording element to replace the toner particles that were removed with the receiver sheet.

The invention, and its objects and advantages, will become more apparent in the detailed description of the preferred embodiment presented below.

BRIEF DESCRIPTION OF THE DRAWINGS

In the detailed description of the preferred embodiments of the invention below, reference is made to the accompanying drawings, in which.

DETAILED DESCRIPTION OF THE BEST MODE

Figure 1:
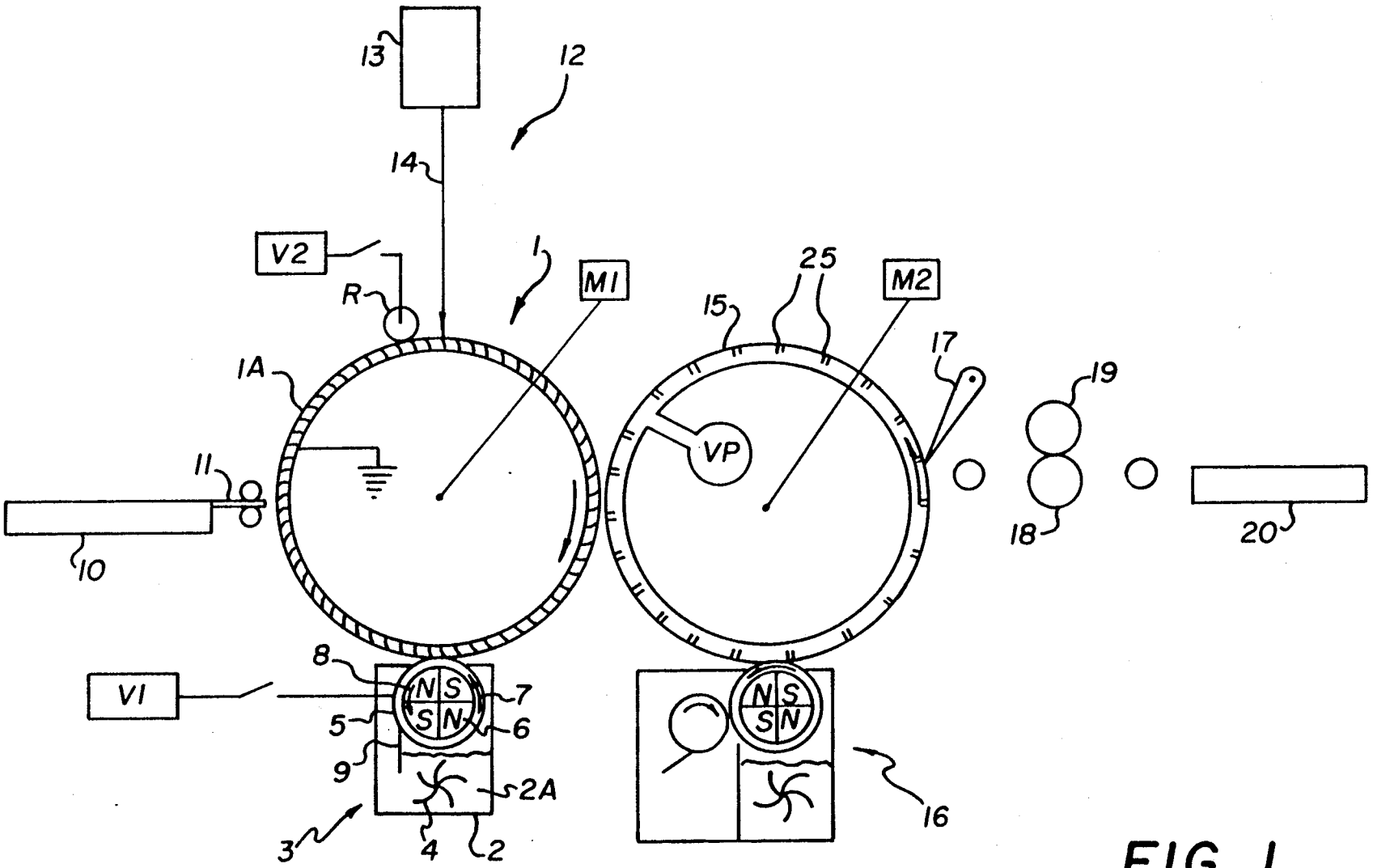
FIG. 1 is a side schematic view of an apparatus for reproducing image information representing one embodiment of the present invention.
Figure 3:
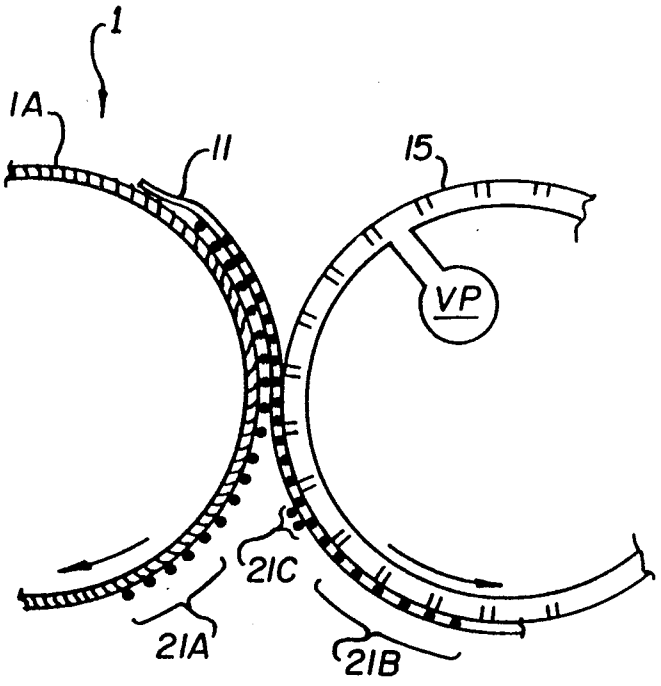
FIG. 3 is a side schematic view of the receiver sheet removal step.
Figure 2:
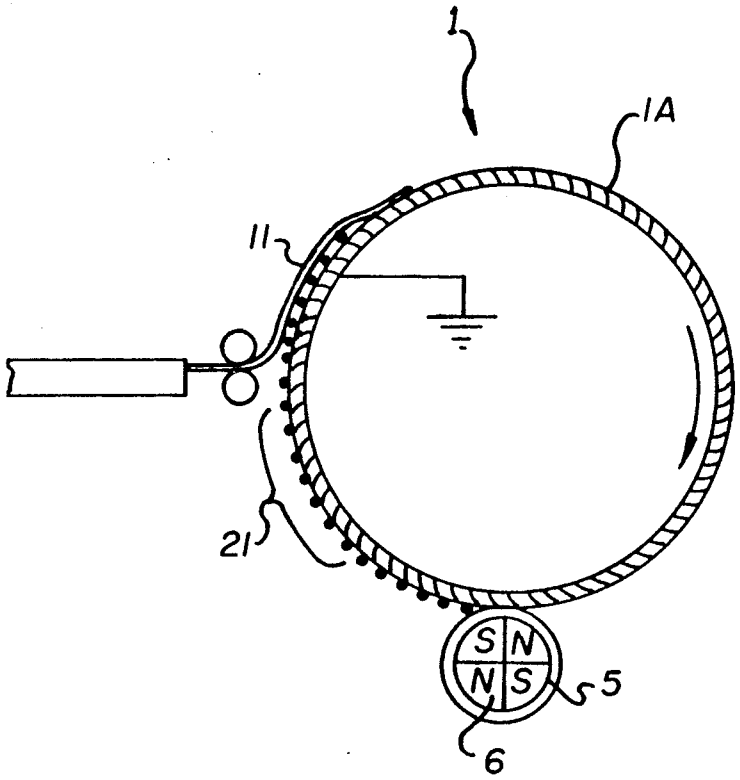
FIG. 2 is a side schematic view of the toner application and receiver sheet overlay steps.

The present invention will be described with reference to FIGS. 1-3. A process drum, designated generally by the reference numeral 1, has an outer conductive layer 1A connected to ground. The drum may have a thin dielectric layer (not shown) over the conductive layer. The process drum is driven in a clockwise direction (as indicated by the arrow) at a constant surface velocity (e.g. about 4 inches/second) by a motor M1. Located proximate along the perimeter of process drum 1 is a magnetic brush applicator, designated generally by the reference numeral 3. The magnetic brush applicator is of conventional design and may include, for example, a cylindrically-shaped magnetic core having a series of axially-extending magnets 6, of alternating polarity, disposed about its periphery. Concentrically arranged with respect to the magnetic core is a nonmagnetic outer sleeve 5, e.g. made of aluminum. The periphery of sleeve 5 is located a small distance from conductive layer 1A. Means (not shown) are provided for producing relative rotational movement between the sleeve 5 and the magnetic core.

The magnetic brush is mounted within a sump housing 2 containing a developer mix 2A. A rotatably driven auger 4 supplies developer mix to the surface of shell 5. The developer mix is comprised of magnetic carrier particles and toner particles. The carrier and toner particles are triboelectrically charged to opposite polarities by the mixing action of the auger and are attracted to each other. The magnetic carrier particles are attracted to magnets 6, causing the developer mix to adhere to shell 5. Shell 5 is rotated in the direction of an arrow 7, typically at a speed of between about 5-100 rpm, while magnets 6 are rotated in the direction of arrow 8, typically at a speed of between about 200-3500 rpm. Alternatively, shell 5 may be stationary while the core rotates. The relative movement between shell 5 and magnets 6 exposes the developer mix on the surface of shell 5 to alternating polarity magnetic fields. This causes the magnetic carrier particles to tumble about the surface of shell 5.

A bias potential is applied to the surface of shell 5 by a voltage supply V1. This bias potential is of the same polarity as the triboelectric charge on the toner particles and, in a preferred embodiment, will have a magnitude of between about 100 and 500 volts. When the developer mix tumbles into the region between shell 5 and drum 1, toner particles in the developer mix will be attracted to grounded conductive layer 1A of drum 1 and repelled from shell 5. This causes a uniform layer of toner particles to be deposited on the surface of drum 1. After the layer of toner particles has been deposited on the surface of drum 1, voltage supply V1 is switched off, stopping the deposition of toner particles on the drum. The rotation of auger 4 is discontinued which stops the supply of developer mix 2A to shell 5. A skive 9 strips the toner-particle-depleted developer mix from the surface of the shell.

The uniform layer of toner particles on the surface of drum 1 is transported in a clockwise direction by drum 1. A receiver sheet supply 10 feeds a receiver sheet 11 onto the surface of drum 1. The receiver sheet covers substantially the entire surface of drum 1 and is positioned to overlay the uniform layer of toner particles. Receiver sheet 11 has an outer layer (adjacent the layer of toner particles) comprised of a thermoplastic material such as poly-iso-butyl-methacrylate. Below this layer is a conductive layer, preferably comprised of cuprous iodide, and a support layer, preferably comprised of KODAK ESTAR TM film base. Receiver sheet 11 is held to drum 1 by conventional means, such as with mechanical fingers or clamps (not shown).

During the laser exposure step (explained below) the conductive layer of receiver sheet 11 is connected to a voltage supply V2 by a conductive roller R. Roller R contacts a conductive strip located on the support layer which is connected to the conductive layer. The conductive strip extends from the leading edge of receiver sheet 11 to the trailing edge. A bias voltage of preferably between about 0 to 1000 volts of a polarity opposite that of the triboelectric charge on the toner particles is placed on the conductive layer of receiver sheet 11. This causes the layer of toner particles to be attracted to receiver sheet 11. The uniform layer of toner particles with receiver sheet 11 overlaying it now approaches a laser exposure station, designated generally by the reference numeral 12.

Laser exposure station 12 includes a laser source 13 which emits an intensity-modulated laser beam 14 according to image information to be recorded. The wavelength of beam 14 is such as to be transmitted by the film base conductive layer and thermoplastic layer of receiver sheet 11. Alteratively, the thermoplastic layer can be made absorptive of the laser beam by the addition of infrared absorbing materials in the thermoplastic layer. Prior to laser exposure, drum 1 is accelerated to a surface velocity of about 150 inches/second. At this surface speed a 20 micron diameter laser spot of 200 milliwatts can be used. To imagewise expose the uniform layer of toner particles now positioned between the receiver sheet and process drum, the laser diode is moved slowly from one edge of the drum to the other edge. Thus, image information is recorded in lines perpendicular to the axis of rotation of the drum.

Preferably, laser beam 14 is focused on the toner particle layer near the interface between the toner particle layer and the receiver sheet. In this case the receiver sheet 11 must be transparent to laser beam 14 (alternatively, the laser beam can be focused on the thermoplastic layer). Those toner particles exposed to the laser beam are heated. The heated toner particles soften the adjacent portions of the thermoplastic layer and adjacent toner particles, thereby enabling these particles to migrate into the thermoplastic layer under the influence of the toner particles' attraction to the conductive layer of the receiver sheet. Toner particles which were not exposed to the laser beam are not heated and cannot penetrate into the thermoplastic layer because the layer remains in a hardened state.

After laser exposure is complete, drum 1 is decelerated to a surface velocity of about 4 inches/second. Bias voltage V2 on the conductive layer of receiver sheet 11 is reduced to zero or alternatively, the polarity of bias voltage V2 is reversed. This will cause unheated toner particles to be attracted to drum 1. The toner particle layer and receiver sheet 11 are transported by drum 1 to a transfer drum 15. Drum 15 is rotated by a motor M2 in the opposite direction of drum 1 at substantially the same constant velocity as drum 1. As the leading edge of receiver sheet 11 approaches the interface between process drum 1 and transfer drum 15, the mechanical clamps (not shown) holding the leading edge of receiver sheet 11 to process drum 1 are opened. Simultaneously, a vacuum is applied by a vacuum pump VP through vacuum holes 25 in the surface of transfer drum 15. This vacuum causes the leading edge of receiver sheet 11 to transfer from process drum 1 to transfer drum 15. As further portions of receiver sheet 1 enter the interface between process drum 1 and transfer drum 15, the mechanical clamps holding these portions of receiver sheet 11 to process drum 1 are opened allowing receiver sheet 11 to release from process drum 1 and adhere to drum 15. The entire receiver sheet is now on the transfer drum.

As receiver sheet 11 is transferred from process drum 1 to transfer drum 15, it takes with it toner particles 21B that migrated into the thermoplastic layer. Toner particles 21A which did not migrate into the thermoplastic layer remain on the surface of drum 1 due to their electrostatic attraction to grounded conductive layer 1A of drum 1. The result is a visible toned image on the surface of receiver sheet 11. To prepare drum 1 for the next copying cycle magnetic brush applicator 3 applies toner particles to drum 1 to replenish the toner particle layer where toner particles were removed by the receiver sheet.

Receiver sheet 11, now on the surface of transfer drum 15 and bearing a toned image, approaches a magnetic brush cleaner, generally designated by reference numeral 16. Magnetic brush cleaner 16 is used to remove any background toner particles 21C which remain on the surface of receiver sheet 11. Such a magnetic brush cleaner is disclosed in U.S. Pat. No. 4,571,071, issued in the name of Bothner on Feb. 18, 1986, which is incorporated herein by reference. In a preferred embodiment of the present invention, the magnetic brush cleaner will utilize magnetic carrier particles having a coercivity of greater than 100 oersteds (termed hard magnetic carrier particles). Examples of such hard carrier particles are barrium ferrite and strontium ferrite. These magnetic carrier particles, when used in the magnetic brush cleaner, will provide a gentle yet thorough cleaning of receiver sheet 11 without disturbing the toned image thereon.

Receiver sheet 11 is transported by transfer drum 15 to pick-off blade 17 which removes receiver sheet 11 from the surface of transfer drum 15. Vacuum pump VP may be shut off to assist in the removal of the receiver sheet from drum 15.

Receiver sheet 11 is drawn through a nip formed by a fusing roller 18 and a backing roller 19. Fusing roller 18 is maintained at an elevated temperature and permanently fuses the toned image to receiver sheet 11. Receiver sheet 11 is then deposited in an exit hopper 20.

The invention has been described in detail with particular reference to preferred embodiments thereof, but it will be understood that variations and modifications can be effected within the spirit and scope of the invention.

What is claimed is:

1. A method of reproducing image information, comprising the steps of:

applying a substantially uniform layer of toner particles to a surface;

placing a receiver sheet, having a thermoplastic outer layer, over said layer of particles, said thermoplastic layer contacting said layer of particles;

establishing an electrostatic attraction between said layer of particles and said receiver sheet; while imagewise exposing said thermoplastic layer to heat such that the thermoplastic layer is selectively softened, allowing toner particles opposite the softened thermoplastic to migrate into the thermoplastic, thereby producing a toner image in said thermoplastic layer; and removing said receiver sheet from said surface.

2. The method of reproducing image information as defined in claim 1, further comprising the step of:

removing background toner particles from said receiver sheet.

3. The method of reproducing image information as defined in claim 2, further comprising the step of:

reapplying toner particles to those areas of said surface where toner particles were removed by said receiver sheet.

4. The method of reproducing image information as defined in claim 3 wherein said applying and reapplying steps are accomplished with a magnetic brush.

5. The method of reproducing image information as defined in claim 4 wherein said surface is the surface of a drum.

6. The method of reproducing image information as defined in claim 5 wherein said heat-inducing energy is a laser beam.

7. The method of reproducing image information as defined in claim 6 wherein said step of removing any untacked background particles is accomplished with a second magnetic brush.

8. The method of reproducing image information as defined in claim 7 wherein said second magnetic brush utilizes magnetic carrier particles having a coercivity greater than 100 oersteds.

9. The method of reproducing image information as defined in claim 1 wherein said imagewise exposure is made through said receiver sheet.

10. An image reproducing apparatus comprising:

means for applying a uniform layer of toner particles to a surface;

means for placing a receiver sheet, having a thermoplastic outer layer, over said layer of particles, said thermoplastic layer contacting said layer of particles;

means for establishing an electrostatic attraction between said layer of particles and said receiver sheet;

means for imagewise exposing said thermoplastic layer to heat, while said electrostatic attraction is established, such that the thermoplastic layer is selectively softened, allowing toner particles opposite the softened thermoplastic to migrate into the thermoplastic, thereby producing a toner image in said thermoplastic layer; and means for removing said receiver sheet from said surface.

11. An image reproducing apparatus as defined in claim 10, further comprising:

means for removing unmigrated background toner particles from said receiver sheet.

12. The image reproducing apparatus as defined in claim 11, further comprising:

means for reapplying toner particles to those areas of said surface where toner particles were removed by said receiver sheet.

13. The image reproducing apparatus as defined in claim 12 wherein said means for applying a uniform layer of toner particles and said means for reapplying toner particles comprises a magnetic brush.

14. The image reproducing apparatus as defined in claim 13 wherein said surface is the surface of a drum.

15. The image reproducing apparatus as defined in claim 14 wherein said means for imagewise exposing said layer of particles to heat-inducing energy comprises a laser.

16. The image reproducing apparatus as defined in claim 15 wherein said means for removing any untacked background particles comprises a magnetic brush.

17. The image reproducing apparatus as defined in claim 16 wherein said magnetic brush cleaner utilizes magnetic carrier particles having a coercivity greater than 100 oersteds.

18. The image reproducing apparatus as defined in claim 10 wherein said imagewise exposing means is effective to cause imagewise exposure through said receiver sheet.

* * * * *